US010009959B2

(12) United States Patent
Anton Falcon et al.

(10) Patent No.: US 10,009,959 B2
(45) Date of Patent: Jun. 26, 2018

(54) COOKER HOB DEVICE

(75) Inventors: Daniel Anton Falcon, Zaragoza (ES); José Miguel Burdio Pinilla, Zaragoza (ES); Claudio Carretero Chamarro, Zaragoza (ES); Jose Maria De la Cuerda Ortin, Zaragoza (ES); Jose Ramon Garcia Jimenez, Friedberg (ES); Ignacio Garde Aranda, Zaragoza (ES); Pablo Jesus Hernandez Blasco, Cuarte de Huerva (ES); Sergio Llorente Gil, Zaragoza (ES); Denis Navarro Tabernero, Zuera (ES); Jose Joaquin Paricio Azcona, Zaragoza (ES); Diego Puyal Puente, Zaragoza (ES)

(73) Assignee: BSH Hausgeräte GmbH, Munich (DE)

( * ) Notice: Subject to any disclaimer, the term of this patent is extended or adjusted under 35 U.S.C. 154(b) by 930 days.

(21) Appl. No.: 13/805,008

(22) PCT Filed: Jun. 27, 2011

(86) PCT No.: PCT/IB2011/052806

§ 371 (c)(1),
(2), (4) Date: Dec. 18, 2012

(87) PCT Pub. No.: WO2012/001603

PCT Pub. Date: Jan. 5, 2012

(65) Prior Publication Data

US 2013/0087554 A1 Apr. 11, 2013

(30) Foreign Application Priority Data

Jun. 28, 2010 (ES) ..... 201030991

(51) Int. Cl.
*H05B 6/04* (2006.01)
*H05B 6/12* (2006.01)
(Continued)

(52) U.S. Cl.
CPC ..... *H05B 6/062* (2013.01); *H05B 6/065* (2013.01)

(58) Field of Classification Search
CPC ..... H05B 6/062; H05B 6/065; H05B 6/1209; H05B 6/1236; H05B 6/04; H05B 6/12; H01H 9/00; H01H 47/00
(Continued)

(56) References Cited

U.S. PATENT DOCUMENTS

2008/0203087 A1 8/2008 Schilling et al.
2011/0240632 A1 10/2011 Anton Falcon et al.

FOREIGN PATENT DOCUMENTS

EP 1361780 B1 1/2006
EP 1931177 A1 6/2008
WO WO 2007042318 A1 * 4/2007 ..... H05B 6/06

OTHER PUBLICATIONS

Full German to English translation of EP 1 931 177 A1.*
(Continued)

*Primary Examiner* — Michael Hoang
(74) *Attorney, Agent, or Firm* — Michael E. Tschupp; Andre Pallapies; Brandon G. Braun

(57) ABSTRACT

A cooker hob device, in particular to an induction cooker hob device, includes at least one switching unit and at least one control apparatus. In order to obtain a high degree of efficiency, the control apparatus is constructed to automatically prompt the at least one switching unit in at least one operating cycle to switch in at least one entire first time interval using at least one switching parameter having a value which changes at least substantially continuously.

29 Claims, 3 Drawing Sheets

(51) Int. Cl.
*H01H 9/00* (2006.01)
*H01H 47/00* (2006.01)
*H05B 6/06* (2006.01)

(58) Field of Classification Search
USPC ..... 219/621–622, 660–662; 361/139, 160, 361/189, 190
See application file for complete search history.

(56) References Cited

OTHER PUBLICATIONS

International Search Report PCT/IB2011/052806 completed Sep. 28, 2011.
National Search Report ES 201030991 dated Jul. 26, 2012.

* cited by examiner

COOKER HOB DEVICE

BACKGROUND OF THE INVENTION

The invention is based on a cooktop apparatus.

A cooktop apparatus having a switching unit configured as a bipolar transistor with insulated gate electrode (hereafter referred to as IGBT) and a control unit is known from the publication WO 2007/042318 A1. To discharge a link capacitor, the control unit activates the IGBT so that the IGBT is not fully enabled and switches to a linear operating mode.

BRIEF SUMMARY OF THE INVENTION

The object of the invention is in particular to provide a generic apparatus with improved properties in respect of a high level of efficiency. The object is achieved by the advantageous embodiments and developments of the invention.

The invention is based on a cooktop apparatus, in particular an induction cooktop apparatus, having at least one switching unit and at least one control apparatus.

It is proposed that the control apparatus is provided to prompt at least the switching unit automatically in at least one operating cycle to switch in at least one entire first time interval using at least one switching parameter, the value of which changes at least substantially continuously. A "switching unit" refers in particular to a unit, which is provided to establish and break at least one electrically conducting contact, the unit preferably having at least one transistor and/or at least one IGBT. A "control apparatus" refers in particular to an electronic unit, which is provided to control at least one operating sequence, the unit preferably having at least one computation unit and/or a storage unit and/or a stored operating program. "Provided" means in particular specifically designed and/or specifically equipped and/or specifically programmed. The statement that the switching parameter "changes at least substantially continuously" should be understood to mean in particular that the switching parameter changes continuously and/or viewed as a time-dependent function has as a maximum stages which amount to as a maximum 30%, preferably as a maximum 15% and particularly preferably as a maximum 5% of its value. The statement that the control apparatus is provided to prompt the switching unit "automatically" to switch using a changing switching parameter is intended to mean in particular that the control apparatus is provided to prompt the changing of the switching parameter which the switching unit uses to switch, independently of any intervention on the part of a user, the control apparatus preferably being provided to prompt the changing of the switching parameter while a cooking zone, which is heated using the switching unit, is operated at a constant heat setting. "Switching" of a switching unit is intended in particular to mean the establishing and/or breaking of at least one electrically conducting contact. The statement that the switching unit switches in at least one "entire" time interval using a changing switching parameter means in particular that the time interval is free of time periods for the entire duration of which the switching parameter assumes a constant value. An inventive embodiment allows a high level of efficiency to be achieved. In particular it is possible to influence a current flowing through a heating element in a flexible manner. In particular it is possible for an envelope curve of a current flowing through the heating element to be quickly increased or reduced to zero within a time period, which is temporally distanced from minima of a rectified power network voltage, which brings about a current flow through the heating element during the operating cycle, in such a manner that the noise development that results from discontinuously changing currents flowing through the heating element and causing noisy energizing of a cookware element can be largely avoided.

It is further proposed that the control apparatus is provided to bring about inactivity of the switching unit during an entire inactivity time interval that is at least one millisecond long during the operating cycle, said inactivity time interval directly adjoining the first time interval. "Inactivity" of the switching unit refers in particular to a complete absence of switching operations. The fact that the inactivity time interval "directly" adjoins the first time interval means in particular that a start point or end point of the inactivity time interval is identical to an end point or start point of the first time interval. This allows a high level of flexibility to be achieved. In particular a conserving switching of a switching element, which is connected to the switching unit in a conducting manner, can be achieved during the inactivity interval.

The control apparatus is preferably provided to switch the switching unit during the operating cycle so that the value of the switching parameter changes substantially continuously in a second time interval directly adjoining the inactivity time interval. This allows a current flowing through the heating element to be effectively influenced. In particular the heating element can be operated with little noise, while the heating element heats a cookware element.

It is further proposed that the control apparatus is provided to switch at least one switching element, which is connected to the switching unit in an electrically conducting manner in at least one operating state, during the inactivity time interval. This allows conserving switching of the switching element to be achieved. In particular a contact of the switching element can be established and/or broken, while no current flows through said contact.

It is also proposed that an overall duration of the first time interval is around two milliseconds. The statement that the overall duration is "around" two milliseconds means in particular that the overall duration deviates by a maximum of 80%, preferably a maximum of 50% and particularly preferably a maximum of 10% from two milliseconds. This allows efficient operation of the heating element to be achieved. In particular the envelope curve of the current flowing through the heating element can be lowered or increased to an infinite value quickly and with little noise.

The control apparatus is preferably provided to switch the switching unit during an entire further time interval, which directly precedes the first time interval, using an at least substantially constant value of the switching parameter. The statement that the control apparatus is provided to switch the switching unit during an entire further time interval using an "at least substantially constant value of the switching parameter" means in particular that the control apparatus is provided to switch the switching unit during the entire further time interval and in this process the switching parameter only assumes values which deviate as a maximum 30%, preferably as a maximum 10% and particularly preferably as a maximum 2% from one another. This allows a simple mode of operation to be achieved.

It is further proposed that the control apparatus is provided to set different lengths for the further time interval for setting a heat output. This allows flexible heating to be achieved. In particular it is possible to set low heat outputs in a simple manner with little noise.

It is further proposed that the switching unit conveys current for operation of at least one cooking zone during the operating cycle and the control apparatus is provided to operate the cooking zone at a single heat setting at least during the first time interval during the operating cycle. A "heat setting" refers in particular to a value set by and indicated to a user, which symbolizes an average heat output and/or an average temperature used to heat a cookware element disposed on a cooking zone. This allows flexible heating to be achieved. In particular an inverter, which has at least one IGBT, can supply current for simultaneously occurring heating operations of two heating elements, which heat different cookware elements.

It is also proposed that the switching parameter is a frequency. This allows a simple mode of operation to be achieved. In particular it is possible to influence a current flowing through the heating element in a simple manner.

It is further proposed that the switching unit has at least one IGBT and the control apparatus is provided to enable the IGBT fully during the first time interval. This allows a high level of efficiency to be achieved.

It is also proposed that the control apparatus is provided to cause a current produced by a rectified power network alternating current voltage to flow at least temporarily through the switching unit during the operating cycle and that the first time interval is temporally distanced from all minima of the rectified power network alternating current voltage. This allows a high level of flexibility to be achieved. In particular it is possible to achieve a flexible temporal relationship between the first time interval and the minima of the rectified power network alternating current voltage.

A cooktop having a cooktop apparatus is also proposed, with which a high level of efficiency can be achieved.

A cooktop operating method, in particular for operating a cooktop apparatus, is also proposed, in which a control apparatus automatically prompts at least one switching unit to switch in at least one entire first time interval using at least one switching parameter, the value of which at least changes substantially continuously. This allows a high level of efficiency to be achieved.

Further advantages will emerge from the description of the drawing which follows. The drawing shows an exemplary embodiment of the invention. The drawing, description and claims contain numerous features in combination. The person skilled in the art will expediently also consider the features individually and combine them in further expedient combinations.

DETAILED DESCRIPTION OF EXEMPLARY EMBODIMENTS OF THE PRESENT INVENTION

Figure 1:
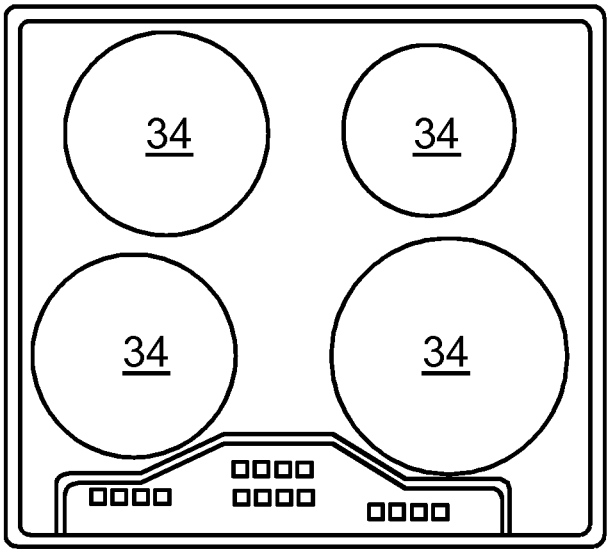
FIG. 1 shows a plan view of a cooktop having an inventive cooktop apparatus.

FIG. 1 shows a plan view of a cooktop having an inventive cooktop apparatus configured as an induction cooktop apparatus, which has a number of cooking zones 34. A circuit 36 (FIG. 2) of the cooktop apparatus has four heating elements $L_1$, $L_2$, $L_3$, $L_4$ configured as coils, which can all be operated at the same time at different power settings. Just one of the cooking zones 34 is assigned to each of the heating elements $L_1$, $L_2$, $L_3$, $L_4$, so that when the cooktop is used, each of the heating elements $L_1$, $L_2$, $L_3$, $L_4$ heats just one cookware element, in other words for example a pot or pan. The circuit 36 has a switching apparatus 10, which has a first and second switching unit 28, 30. The first switching unit 28 is formed by a first inverter 28' and the second switching unit 30 is formed by a second inverter 30'. The first inverter 28' has a first bipolar transistor with insulated gate electrode (the abbreviation IGBT is used in the following for this) 32 and a second IGBT 33. The inverter 30' also has a first IGBT 44 and a second IGBT 46.

The circuit 36 also has a regionally specific alternating current voltage source U, which supplies a power network alternating current voltage with an effective value of 230 V and a frequency of 50 Hz. The described cooktop apparatus is provided in particular for operation in Germany. For cooktop apparatuses that are provided for operation in the US, a corresponding alternating current voltage source supplies a power network voltage at 60 Hz. The voltage of the alternating current voltage source U first passes through a filter 40 of the circuit 36, which eliminates high-frequency noise and is essentially a low pass filter. A voltage filtered by the filter 40 is rectified by a rectifier 42 of the circuit 36, which can be configured as a bridge rectifier, so that a rectified voltage $U_g$ (FIG. 3) is emitted at an output of the rectifier 42, being present between a collector of the IGBT 32 and an emitter of the IGBT 33. The rectified voltage $U_g$ is also present between a collector of the IGBT 44 and an emitter of the IGBT 46. The circuit 36 also has two capacitors $C_1$, $C_2$. A first contact of the capacitors $C_1$, $C_2$ respectively is connected in a conducting manner to the collector of the IGBT 32 and in a conducting manner to a collector of the IGBT 44. A second contact of the capacitors $C_1$, $C_2$ respectively is also connected in a conducting manner to the emitter of the IGBT 33 and in a conducting manner to the emitter of the IGBT 46. An emitter of the IGBT 32 is connected in a conducting manner to a collector of the IGBT 33. An emitter of the IGBT 44 is also connected in a conducting manner to a collector of the IGBT 46.

The circuit 36 also has a switching element $S_1$ configured as a relay $S_1'$ and five further relays $S_2$, $S_3$, $S_4$, $S_5$, $S_6$. The relays $S_1'$, $S_2$, $S_3$, $S_4$, $S_5$, $S_6$ are SPDT relays of identical structure. Each of the relays $S_1'$, $S_2$, $S_3$, $S_4$, $S_5$, $S_6$ has a first, second and third contact and a coil, the first contact being able to be connected optionally to the second or third contact in a conducting manner by corresponding activation of the coil.

The first contact of the relay $S_3$ is connected in a conducting manner to the emitter of the IGBT 32. The second contact of the relay $S_3$ is also connected to the first contact of the relay $S_1'$. The third contact of the relay $S_3$ is connected in a conducting manner to the first contact of the relay $S_2$. The second contact of the relay $S_1'$ is connected in a conducting manner to a first contact of the heating element $L_1$. The third contact of the relay $S_1'$ is connected in a conducting manner to a first contact of the heating element $L_2$. The second contact of the relay $S_2$ is connected in a conducting manner to a first contact of the heating element $L_3$. The third contact of the relay $S_2$ is connected in a conducting manner to a first contact of the heating element $L_4$.

The first contact of the relay $S_6$ is also connected in a conducting manner to the emitter of the IGBT 44. The second contact of the relay $S_6$ is also connected to the first contact of the relay $S_4$. The third contact of the relay $S_6$ is connected in a conducting manner to the first contact of the relay $S_5$. The second contact of the relay $S_4$ is connected in a conducting manner to a first contact of the heating element $L_1$. The third contact of the relay $S_4$ is also connected in a conducting manner to a first contact of the heating element $L_2$. The second contact of the relay $S_5$ is connected in a conducting manner to a first contact of the heating element $L_3$, The third contact of the relay $S_5$ is connected in a conducting manner to a first contact of the heating element $L_4$.

A second contact of the heating element $L_1$ is connected in a conducting manner to a second contact of the heating element $L_2$. A second contact of the heating element $L_3$ is also connected in a conducting manner to a second contact of the heating element $L_4$. The circuit 36 also has capacitors $C_3$, $C_4$, $C_5$, $C_6$. The second contact of the heating element $L_1$ is connected in a conducting manner to a first contact of the capacitor $C_3$ and to a first contact of the capacitor $C_4$. The second contact of the heating element $L_3$ is connected in a conducting manner to a first contact of the capacitor $C_5$ and to a first contact of the capacitor $C_6$. Second contacts of the capacitors $C_3$ and $C_5$ are connected in a conducting manner to the collector of the IGBT 32. Second contacts of the capacitors $C_4$ and $C_6$ are also connected in a conducting manner to the emitter of the IGBT 46.

Both the IGBT 32 and the IGBT 33 can be used to establish and break a power supply line to the first switching element $S_1$, through which a current generated by means of the alternating current voltage source U flows during an operating cycle. The relays $S_1'$, $S_2$, $S_3$, $S_4$, $S_5$, $S_6$ are initially in the following switching states in the operating cycle: in the case of the relays $S_1'$, $S_2$, $S_3$, $S_4$, $S_5$ the first contact is connected in a conducting manner to the second contact in each instance. In the case of the relay $S_6$ the first contact is connected in a conducting manner to the third contact.

A control apparatus 14 of the circuit 36, which has two control units 56 58, controls the switching apparatus 10 during the operating cycle. To this end the control apparatus 14 is connected to the switching apparatus 10 and in particular to the gate terminals of the IGBTs 32, 33, 44, 46 (not shown).

During the entire operating cycle the control apparatus 14 causes the heating elements L1 and L2 and therefore also the cooking zones 34 assigned to the heating elements L1 and L2 to be operated respectively at a single heat setting and to be supplied with power by the inverter 28' in an alternating manner. The IGBTs 44, 46 are inactive during the operating cycle. During the operating cycle the control apparatus 14 prompts the inverter 28' to switch automatically during a first time interval $t_1$ (FIG. 3) in the entire first time interval $t_1$ using a switching parameter, the value 15 of which changes substantially continuously. The switching parameter is a frequency 31 (FIG. 4), specifically a switching frequency, at which the inverter 28' switches. During a period duration 39, which is one divided by the frequency 31, the IGBT is enabled fully just once so that a conducting connection is present between the emitter and collector of the IGBT 32. Such enabling of the IGBT 32 is prompted by the control apparatus 14. The IGBT 32 also breaks this conducting connection just once during the period duration 39. During the period duration 39 the IGBT 33 is enabled fully just once so that a conducting connection is present between the emitter and collector of the IGBT 33. Such enabling of the IGBT 33 is prompted by the control apparatus 14. The IGBT 33 also breaks this conducting connection just once during the period duration 39. During the period duration just one of the IGBTs 32, 33 is switched at each time point of the period duration 39, so that a conducting connection is present between its collector and emitter. The first time interval $t_1$ is two milliseconds long. During the operating cycle the inverter 28' conveys current for heating the heating elements L1 and L2.

During the operating cycle the control apparatus 14 also causes the inverter 28' to be inactive during an entire inactivity time interval $t_{in}$, which directly adjoins the first time interval $t_1$, so that a conducting connection between the collector and emitter of the IGBT 32 is broken and a conducting connection between the collector and emitter of the IGBT 33 is broken during the entire inactivity time interval. The inactivity time interval $t_{in}$ is more than two milliseconds long. During the inactivity time interval the relay S1' is switched, so that after switching the first contact is connected to the third contact of the relay S1' in a conducting manner. This means that before the inactivity time interval $t_{in}$ energy is supplied to the heating element L1 and after the inactivity time interval $t_{in}$ energy is supplied to the heating element L2 due to activity of the inverter 28'.

Figure 3:
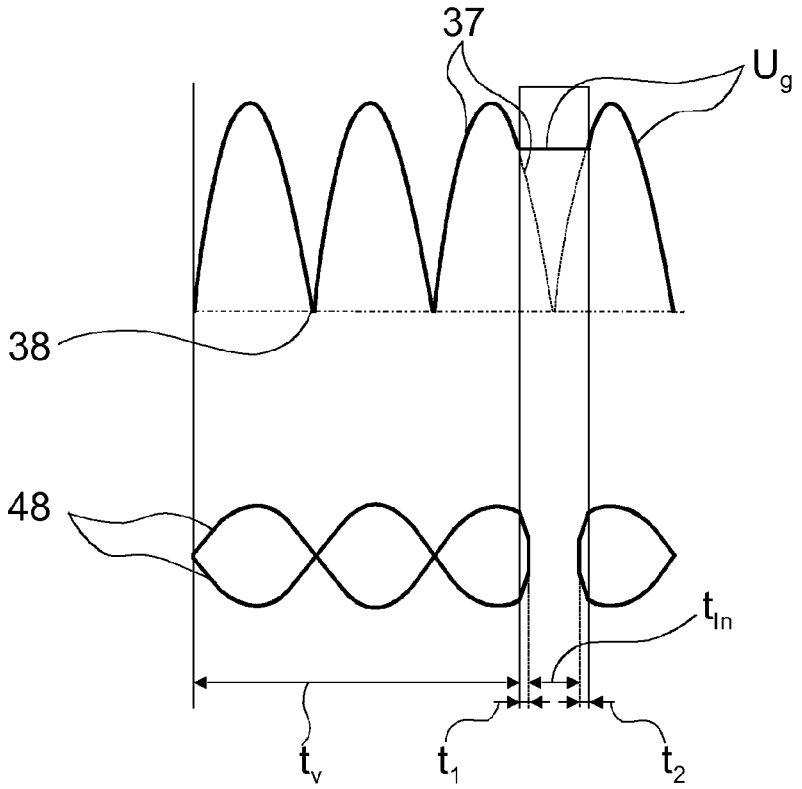
FIG. 3 shows a schematic diagram of a voltage, which is present at a capacitor of the circuit, and a rectified power network alternating current voltage and an envelope curve of a current flowing through heating elements of the circuit, with time shown along an abscissa.
Figure 4:
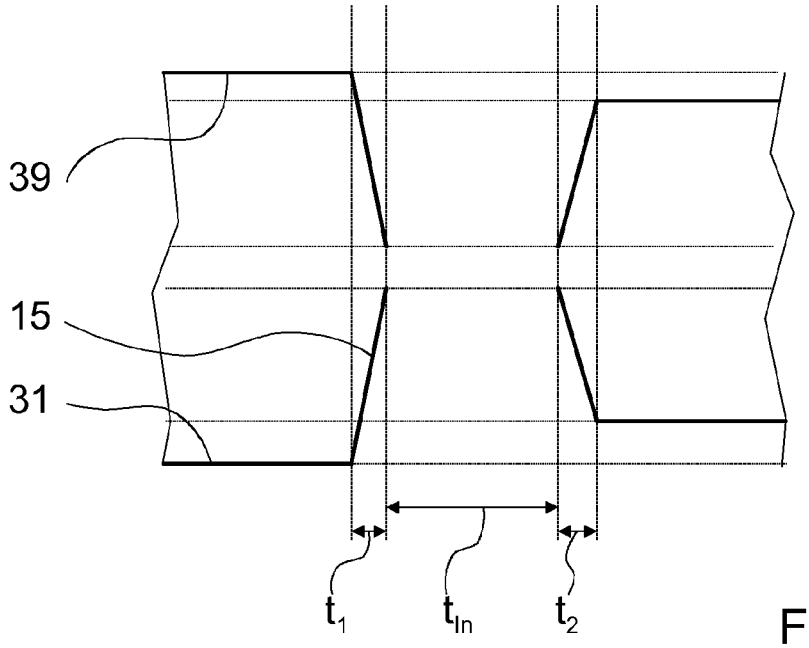
FIG. 4 shows a schematic diagram of a period duration and a switching frequency used by a switching unit of the circuit for switching, with time shown along an abscissa.

The control apparatus 14 also switches the inverter 28' during the operating cycle so that the switching frequency of the inverter 28' changes substantially continuously during a time interval $t_2$ (FIGS. 3 and 4). The time interval $t_2$ directly adjoins the inactivity time interval $t_{in}$. By switching the inverter 28' in the time intervals $t_1$ and $t_2$, an envelope curve 48 of a current flowing through the heating element L1 before the inactivity time interval $t_{in}$ and flowing through the heating element L2 after the inactivity time interval $t_{in}$ is quickly reduced or increased during the time intervals $t_1$ and $t_2$, with the result that noise produced during an abrupt current change and brought about by forces occurring due to the sudden change and acting on positioned cookware elements is avoided.

Also during the operating cycle the control apparatus prompts the inverter 28' to be switched at constant frequency 31 during an entire time interval $t_v$ (FIG. 3). The time interval $t_v$ directly precedes the time interval $t_1$. The control apparatus 14 prompts a quotient, which is defined by the time period during a period duration 39 in which the IGBT 32 is enabled divided by the period duration 39, to be constant during the time intervals $t_1$, $t_v$ and $t_2$.

FIG. 3 shows a rectified power network alternating current voltage 37 supplied by the alternating current voltage source U during the operating cycle. The power network alternating current voltage 37 temporarily produces a current flow through the alternator 28' during the operating cycle. The first time interval $t_1$ is temporally distanced from all minima 38 of the rectified power network alternating current voltage 37.

A maximum value of the frequency 31 is around 200 kHz during the time interval $t_1$. A value of the frequency 31 can be in particular between 30 kHz and 75 kHz during the time interval $t_v$. During the first time interval $t_1$ the period duration 39 decreases gradually in a number of stages by the same time $T_{dec}$ in each instance (not visible in FIG. 4). The width of the stages here is $(T_{max}-i\ T_{dec})/30$ MHz, where $T_{max}$ is a maximum period duration 39 in the time interval $t_v$ and i is the number of the stage in time order. During the second time interval $t_2$ the period duration 39 increases gradually in a number of stages by the same time in each instance, which can be different from the previously cited time (not visible in FIG. 4), with the width of said stages being $(T_{max1}-i\ T_{inc})/30$ MHz and $T_{max1}$ being a value of the period duration directly after the second time interval $t_2$ and i being the number of the stage in time order and $T_{inc}$ the height of the stage, which can be different from $T_{dec}$. A minimum value of the period duration 39 in the time interval $t_1$ can also differ from a minimum value of the period duration 39 during the time interval $t_2$.

During a time interval directly adjoining the time interval $t_2$ the inverter is operated at a constant frequency. After this time interval the relay S1' is switched again, as described above, and the part of the operating cycle described above is repeated.

In principle it is conceivable for the inverter 30' also to be temporarily active during the operating cycle.

In a further operating cycle, which only differs from the operating cycle described above in that the switching element $S_1$ is not switched and the heating element $L_1$ is operated at different heat settings, in other words with different heat outputs, the different heat settings are set by the control apparatus changing lengths of the time interval $t_v$ and/or of the time interval $t_{in}$. In principle it is conceivable here for the time interval $t_1$ to be omitted and an end point of the time interval $t_v$ to be identical to a minimum of the rectified power network alternating current voltage. In principle it is also conceivable for the heating element $L_1$ to be operated at a single heat setting during the further operating cycle.

Figure 2:
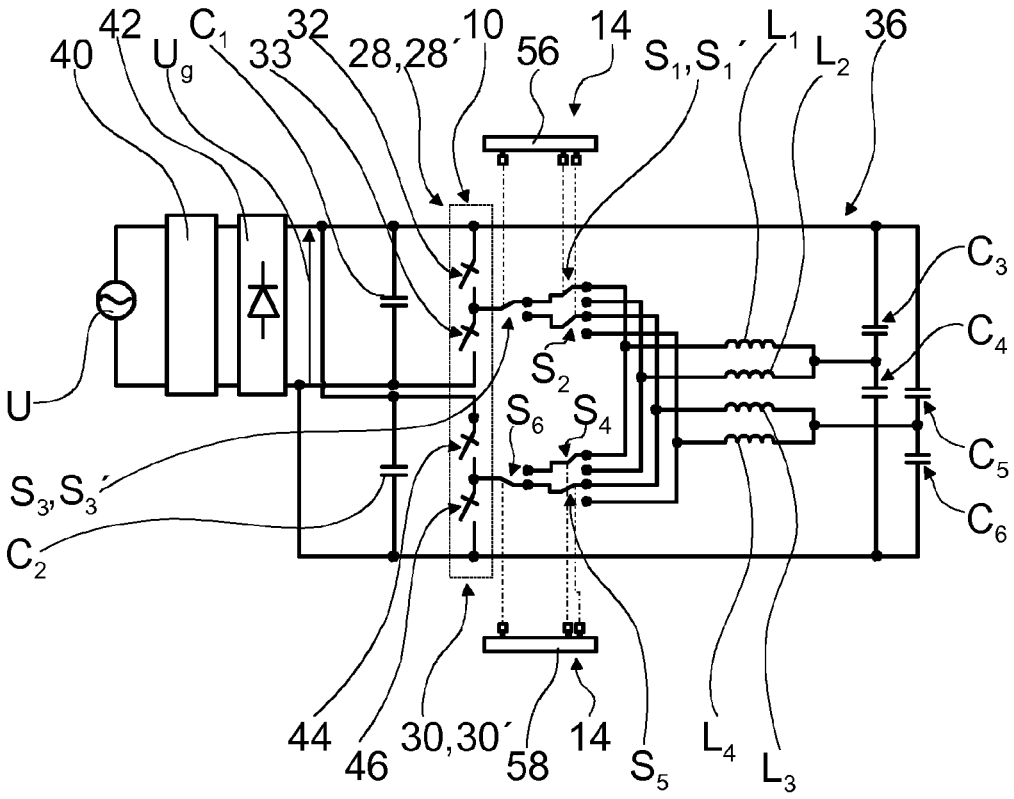
FIG. 2 shows a circuit of the cooktop apparatus.

It is also conceivable for a full-bridge circuit to be used instead of a half-bridge circuit, as shown in FIG. 2, or for a single transistor inverter to be used instead of the inverter 28'.

The invention claimed is:

1. A cooktop apparatus, comprising:

a switching unit; and an electronic controller that automatically prompts the switching unit in an operating cycle to switch between an open position and a closed position in an entire first time interval using a switching parameter having a value which changes during the entire first time interval either (1) continuously, or (2) when viewed as a time-dependent function, in stages where each stage amounts to a maximum of 30% of the value of the switching parameter at the beginning of the entire first time interval, wherein the entire first time interval has an overall duration that deviates by a maximum of 80% from two milliseconds.

2. The cooktop apparatus of claim 1, constructed in the form of an induction cooktop apparatus.

3. The cooktop apparatus of claim 1, wherein the controller is constructed to render, during the operating cycle, the switching unit inactive during an entire inactivity time interval which is at least one millisecond long and which directly adjoins the entire first time interval.

4. The cooktop apparatus of claim 3, wherein the controller is constructed to switch the switching unit during the operating cycle so that the value of the switching parameter changes continuously in a second time interval that directly adjoins the entire inactivity time interval.

5. The cooktop apparatus of claim 3, further comprising a relay switching element connected to the switching unit in an electrically conducting manner in an operating state, the controller being constructed to switch the relay switching element during the entire inactivity time interval, wherein the switching unit includes a transistor.

6. The cooktop apparatus of claim 1, wherein the overall duration of the entire first time interval is two milliseconds.

7. The cooktop apparatus of claim 1, wherein the controller is constructed to switch the switching unit during an entire further time interval, which directly precedes the entire first time interval, using a constant value of the switching parameter.

8. The cooktop apparatus of claim 7, wherein the controller is constructed to set different lengths for the entire further time interval for setting a heat output.

9. The cooktop apparatus of claim 1, wherein the switching unit conveys current for operation of a cooking zone during the operating cycle, the controller being constructed to operate the cooking zone at a single heat setting during the entire first time interval.

10. The cooktop apparatus of claim 1, wherein the switching parameter is a switching frequency of the switching unit.

11. The cooktop apparatus of claim 1, wherein the switching unit has an IGBT, the controller being constructed to fully enable the IGBT during the entire first time interval.

12. The cooktop apparatus of claim 1, wherein the controller causes a current produced by a rectified power network alternating current voltage to flow at least temporarily through the switching unit during the operating cycle, the entire first time interval being temporally distanced from all minima of the rectified power network alternating current voltage.

13. The cooktop apparatus of claim 1, wherein the overall duration of the entire first time interval deviates by a maximum of 50% from two milliseconds.

14. The cooktop apparatus of claim 1, wherein the overall duration of the entire first time interval deviates by a maximum of 10% from two milliseconds.

15. The cooktop apparatus of claim 1, wherein the value of the switching parameter changes during the entire first time interval, when viewed as a time-dependent function, in stages where each stage amounts to a maximum of 15% of the value of the switching parameter at the beginning of the entire first time interval.

16. The cooktop apparatus of claim 1, wherein the value of the switching parameter changes during the entire first time interval, when viewed as a time-dependent function, in stages where each stage amounts to a maximum of 5% of the value of the switching parameter at the beginning of the entire first time interval.

17. The cooktop apparatus of claim 1, wherein the value of the switching parameter changes continuously during the entire first time interval.

18. A cooktop comprising a cooktop apparatus, wherein the cooktop apparatus comprises:

a switching unit; and an electronic controller that automatically prompts the switching unit in an operating cycle to switch between an open position and a closed position in an entire first time interval using a switching parameter having a value which changes during the entire first time interval either (1) continuously, or (2) when viewed as a time-dependent function, in stages where each stage amounts to a maximum of 30% of the value of the switching parameter at the beginning of the entire first time interval, wherein the entire first time interval has an overall duration that deviates by a maximum of 80% from two milliseconds.

19. A cooktop operating method, the method comprising:

automatically prompting, by an electronic controller, a switching unit in an operating cycle to switch between an open position and a closed position an entire first time interval using a switching parameter having a value which changes during the entire first time interval either (1) continuously, or (2) when viewed as a time-dependent function, in stages where each stage amounts to a maximum of 30% of the value of the switching parameter at the beginning of the entire first time interval, wherein the entire first time interval has an overall duration that deviates by a maximum of 80% from two milliseconds.

20. The method of claim 19, further comprising rendering, during the operating cycle, the switching unit inactive during an entire inactivity time interval which is at least one millisecond long and which directly adjoins the entire first time interval.

21. The method of claim 20, further comprising switching the switching unit during the operating cycle so that the value of the switching parameter changes continuously in a second time interval that directly adjoins the entire inactivity time interval.

22. The method of claim 20, further comprising switching at least one switching element, connected to the switching unit in an electrically conducting manner in at least one operating state, during the entire inactivity time interval.

23. The method of claim 19, wherein the entire first time interval has an overall duration of two milliseconds.

24. The method of claim 19, further comprising switching the switching unit during an entire further time interval, which directly precedes the entire first time interval, using a constant value of the switching parameter.

25. The method of claim 24, further comprising setting different lengths for the entire further time interval for setting a heat output.

26. The method of claim 19, further comprising conveying current by the switching unit for operation of at least one cooking zone during the operating cycle, and operate the at least one cooking zone at a single heat setting at least during the entire first time interval during the operating cycle.

27. The method of claim 19, wherein the switching parameter is a frequency.

28. The method of claim 19, further comprising enabling at least one IGBT of the switching unit fully during the entire first time interval.

29. The method of claim 19, further comprising causing a current produced by a rectified power network alternating current voltage to flow at least temporarily through the switching unit during the operating cycle, and temporally distancing the entire first time interval from all minima of the rectified power network alternating current voltage.

* * * * *